US005823127A

United States Patent [19]

Mizuno

[11] Patent Number: 5,823,127

[45] Date of Patent: Oct. 20, 1998

[54] EMBROIDERY DATA PROCESSING APPARATUS

[75] Inventor: Masahiro Mizuno, Nagoya, Japan

[73] Assignee: Brother Kogyo Kabushiki Kaisha, Nagoya, Japan

[21] Appl. No.: 990,814

[22] Filed: Dec. 15, 1997

[30] Foreign Application Priority Data

Dec. 20, 1996 [JP] Japan ..... 8-341554

[51] Int. Cl.[6] ..... D05B 21/00; D05C 5/04

[52] U.S. Cl. ..... 112/102.5; 364/470.09

[58] Field of Search ..... 112/102.5, 407.06, 112/475.19, 456, 458; 364/470.09

[56] References Cited

U.S. PATENT DOCUMENTS 5,210,694 5/1993 Hayakawa ..... 112/102.5 X 5,231,586 7/1993 Shimizu ..... 112/103 X 5,299,514 4/1994 Hayakawa et al. .

*Primary Examiner*—Peter Nerbun

*Attorney, Agent, or Firm*—Oliff & Berridge, PLC

[57] ABSTRACT

An embroidery data processing apparatus includes an underlying stitch area outline device that generates an outline that defines the shape of an area to be stitched for underlying, within an area enclosed by an outline that defines the shape of an area to be embroidered. If the underlying stitch area outline has a self-intersecting portion, a dividing device divides the underlying stitch area outline into a plurality of segmental underlying stitch area outlines using the self-intersecting portion as a boundary. A point at which the underlying stitch area outline intersects itself is set as the stitching start or end point for a segmental underlying stitch area. A segmental underlying stitch data device generates stitch data for each of segmental underlying stitch areas defined by the segmental underlying stitch area outlines. An auxiliary underlying stitch data device generates auxiliary underlying stitch data for a connection between the segmental underlying stitch areas.

16 Claims, 10 Drawing Sheets

EMBROIDERY DATA PROCESSING APPARATUS

BACKGROUND OF THE INVENTION

1. Field of Invention

The invention relates to an embroidery data processing apparatus capable of generating stitch data for forming underlying stitches in an embroidery area.

2. Description of Related Art

Stitch data for stitching an embroidery was conventionally generated by a skilled person determining the position coordinates of a needle location point for each stitch. An embroidery data processing apparatus has recently been developed, which is able to semi-automatically generate stitch data for embroideries by defining an embroidery body that designates the shape, position, size, stitching direction, stitch density, and the like of an area to be embroidered. Such apparatuses are now widely used.

Another apparatus has been devised, for generating and processing stitch data for forming underlying stitches to produce a three-dimensional embroidery appearance or form or to prevent a work cloth from puckering as stitching progresses, particularly for an embroidery wherein a closed area is filled with stitches. Such apparatuses are also used widely. In known methods for generating underlying stitch data, an underlying stitch area outline that defines the shape of an area to be stitched for underlying is formed within a closed area enclosed by an outline that defines the shape of an area to be embroidered. Based on the underlying stitch area outline, the methods generate underlying stitch data. A stitch data generating method taking into consideration an underlying stitch area outline that intersects itself is disclosed in U.S. Pat. No. 5,299,514. In the disclosed method, if an underlying stitch area outline intersects itself, the underlying stitch area is divided into a plurality of segmental underlying stitch areas, and underlying stitch data is generated separately for each segmental underlying stitch area.

However, U.S. Pat. No. 5,299,514 does not mention an underlying stitch data generating method to connect a plurality of segmental underlying stitch areas. In fact, the underlying stitch data generating method disclosed by the patent application has problems in that a thread interconnecting segmental underlying stitch areas may extend out of the embroidery area.

SUMMARY OF THE INVENTION

Accordingly, it is an object of the invention to provide an embroidery data processing apparatus capable of generating underlying stitch data whereby the threads interconnecting segmental underlying stitch areas are contained within a designated embroidery area.

According to the invention, there is provided an embroidery data processing apparatus for processing embroidery data for forming underlying stitches within a closed area enclosed by an outline that defines a shape of an embroidery area. In the apparatus, an underlying stitch area outline generating device generates an underlying stitch area outline that defines a shape of an area to be stitched for underlying. The underlying stitch area outline is generated inside the closed area. If the underlying stitch area outline has a self-intersecting portion, a dividing device divides the underlying stitch area outline into a plurality of segmental underlying stitch area outlines using the self-intersecting portion as a boundary. A segmental underlying stitch data generating device generates underlying stitch data for each of segmental underlying stitch areas defined by the plurality of segmental underlying stitch area outlines. An auxiliary underlying stitch data generating device generates auxiliary underlying stitch data for a connection between the plurality of segmental underlying stitch areas.

If an underlying stitch area outline generated by the underlying stitch area outline generating device has a self-intersecting portion, the dividing device divides the underlying stitch area outline into a plurality of segmental underlying stitch area outlines so that the self-intersecting portion forms a boundary between segmental underlying stitch area outlines. The segmental underlying stitch data generating device then generates underlying stitch data for each of the segmental underlying stitch areas defined by the segmental underlying stitch area outlines. Subsequently, the auxiliary underlying stitch data generating device generates auxiliary underlying stitch data for a connection between the segmental underlying stitch areas. Therefore, it becomes possible to easily generate underlying stitch data whereby the threads interconnecting segmental underlying stitch areas are contained within the embroidery area, even if the underlying stitch area outline intersects itself.

The embroidery data processing apparatus may further include a setting device that sets a point at which the underlying stitch area outline intersects itself, as one of a stitching start point and a stitching end point for the individual segmental underlying stitch areas. Thereby, it becomes possible to generate underlying stitch data that enables the quick embroidering of each segmental underlying stitch area with a high efficiency.

The auxiliary underlying stitch data generated by the auxiliary underlying stitch data generating device may include data for producing running stitches at a given pitch. Thereby, it becomes possible to generate data for running stitches at an appropriate pitch or data for feed-stitching (generally termed as "jump stitching"), as auxiliary underlying stitch data for connections between segmental underlying stitch areas.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
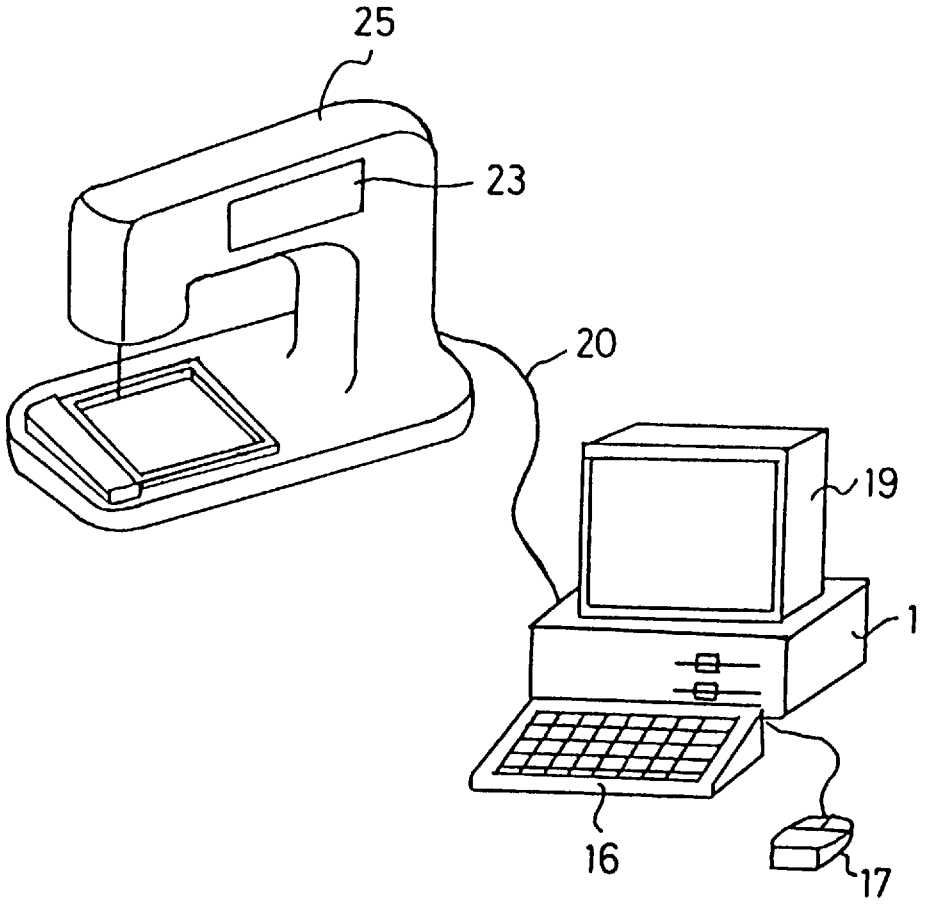
FIG. 1 is a perspective view of the overall arrangement of an embroidery sewing machine and an embroidery data processing apparatus according to an embodiment of the invention.

A preferred embodiment of the invention will be described in detail hereinafter with reference to the accompanying drawings.

An embroidery sewing machine used together with an embodiment of the embroidery data processing apparatus will be briefly described, although not detailed in the drawings. The embroidery sewing machine forms an embroidery pattern in a work cloth held by an embroidery frame disposed on an bed, by operating a horizontal motion mechanism to move the embroidery frame to predetermined positions indicated by the X-Y coordinate system provided specifically for the sewing machine while operating a sewing needle and a shuttle mechanism to stitch.

The horizontal motion mechanism, the needle bar and the like are controlled by a control device formed of a microcomputer and the like. The control device receives embroidering stitch (needle pierce) data that designates a displacement (needle pierce position) of the work cloth in the X and Y-directions for each stitch and, thereby, is able to automatically perform the embroidering operation. In this embodiment, the embroidery sewing machine is equipped with a communication device for receiving embroidery stitch data from an external device. An embroidery data processing apparatus of this embodiment has a function for generating such embroidery stitch data.

FIG. 1 shows the overall arrangement of a sewing machine and an embroidery data processing apparatus according to this embodiment. An embroidery sewing machine 25 is constructed to receive embroidery data from a personal computer 1 through a communication cable 20. The embroidery sewing machine 25 has a display 23 for displaying various messages, such as a message to instruct a user to change the embroidery thread to a different-color thread, and the like.

Figure 2:
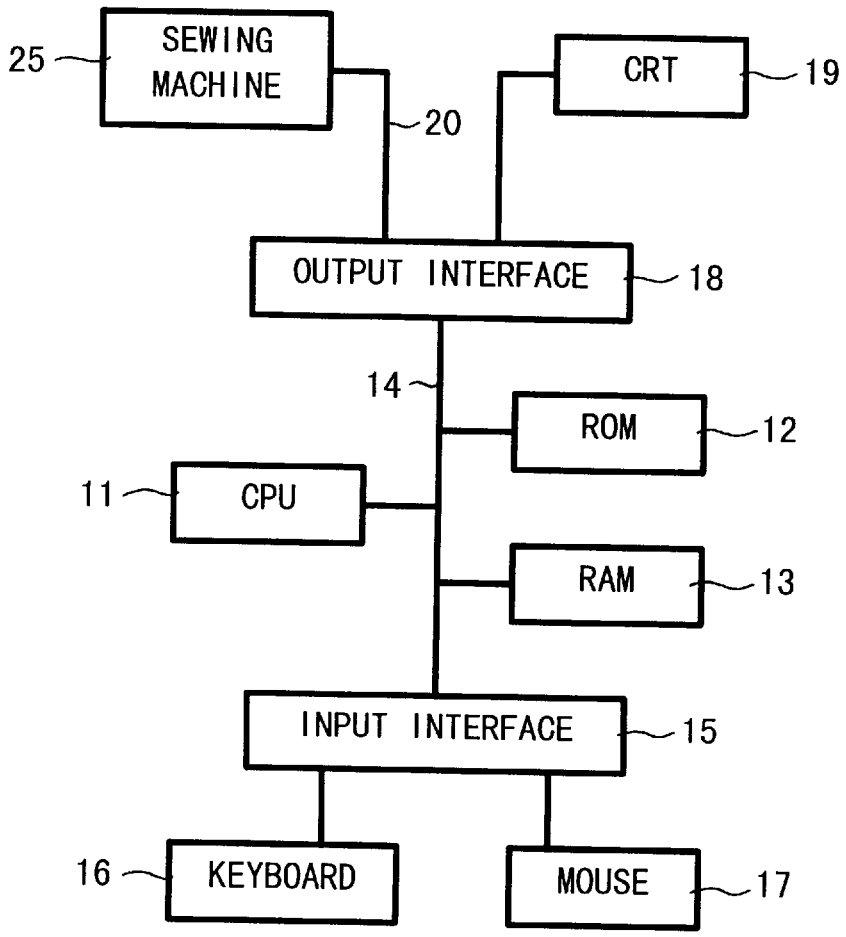
FIG. 2 is a block diagram illustrating the electrical arrangement of the embroidery data processing apparatus of the embodiment of the embodiment.

FIG. 2 illustrates the electrical arrangement of the embroidery data processing apparatus of this embodiment. The apparatus includes a (central processing unit) CPU 11, a read-only memory (ROM) 12, a random-access memory (RA) 13, an input interface 15 and an output interface 18 which are interconnected by a bus 14. The CPU 11 performs control of the entire embroidery data processing apparatus while transmitting and receiving various data and signals. The ROM 12 stores programs and data for control of the embroidery data processing apparatus. The RAM 13 erasably stores data to be inputted from a keyboard 16 or an external storage device.

The embroidery data processing apparatus is equipped with a cathode-ray tube (CRT) display 19 connected to the output interface 18. The CRT display 19 displays various graphics indicating the shapes of embroidery patterns, various messages, and the like.

The keyboard 16 and a mouse 17 are connected to the CPU 11, via the input interface 15. The keyboard 16 has an arrangement of operating keys for a user to input instructions, such as selection of an operation, execution of an operation, and the like. The mouse 17 is a pointing device for, for example, producing or selecting an outline that defines an embroidery shape on the CRT display 19.

The communication cable 20 is connected to the embroidery data processing apparatus by the output interface 18. The embroidery data processing apparatus transmits generated embroidery data to the embroidery sewing machine 25 through the communication cable 20.

The operation of the embroidery data processing apparatus of this embodiment will be described with reference to the flowchart of FIG. 3. In the description of this embodiment, it is assumed that underlying stitch data and embroidery stitch data are generated with respect to an area enclosed by an outline serially connecting points p1–p15 (FIG. 4) in that order.

When the program stored in the ROM 12 for generating embroidery data is started, the CPU 11 sets, in step S1, a stitching start point and a stitching end point with respect to the entire closed area in accordance with the data inputted by a user operating the key board 16 while confirming the input on the CRT display 19.

Figure 4:
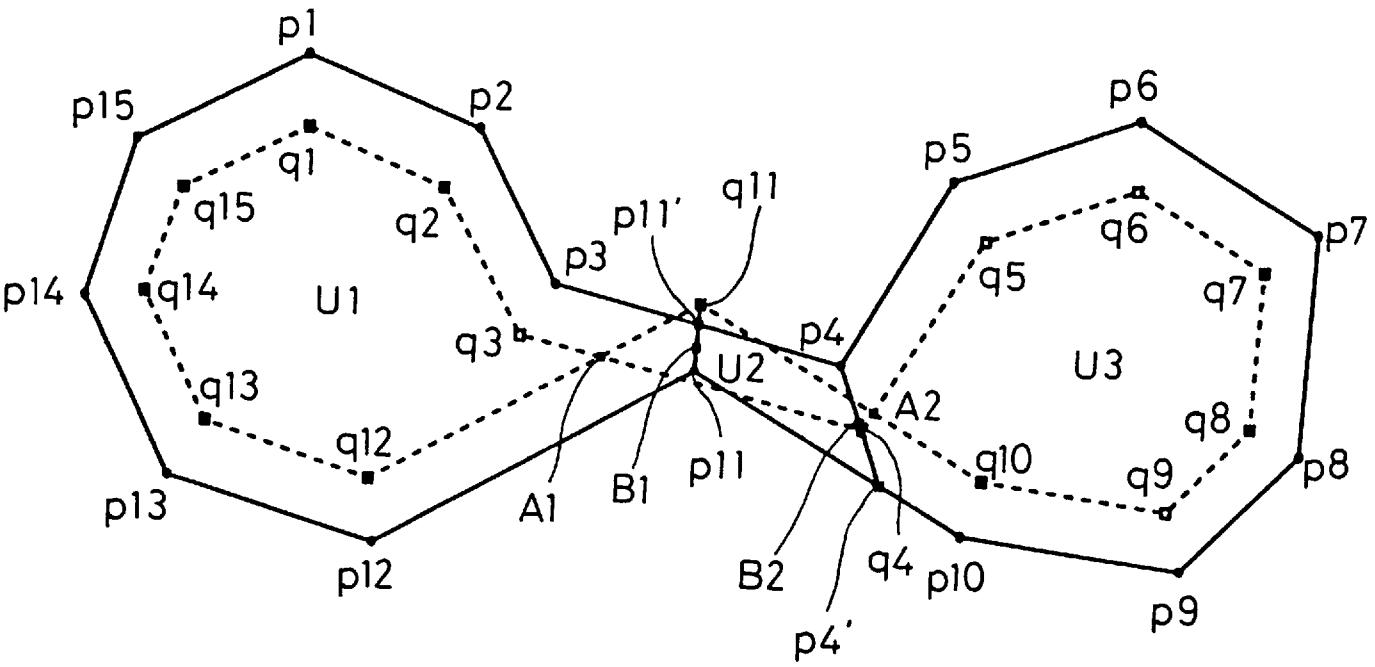
FIG. 4 is a flowchart illustrating an underlying stitch generating method employed by the embroidery data processing apparatus of the embodiment.

In step S2, the CPU 11 generates an outline that defines an underlying stitch area, by executing the program. As shown in FIG. 4, the CPU 11 generates an underlying stitch area outline (indicated by a broken line) connecting points q1–q15. The underlying stitch area outline is a predetermined distant apart inward from the outline connecting the points p1–p15 (indicated by a solid line). The operation of step S2 is described in detail in U.S. Pat. No. 5,299,514, which is incorporated herein by reference.

In step S3, it is determined whether the underlying stitch area outline generated in step S2 intersects itself. The "intersect" itself means that a portion of the underlying stitch area outline intersects another portion of the same underlying stitch area outline. If the underlying stitch area outline intersects itself as shown in FIG. 4 (YES in step S3), the operation proceeds to step S4. If it is determined that there is no self-intersecting point, the operation jumps to step S6.

Figure 7:
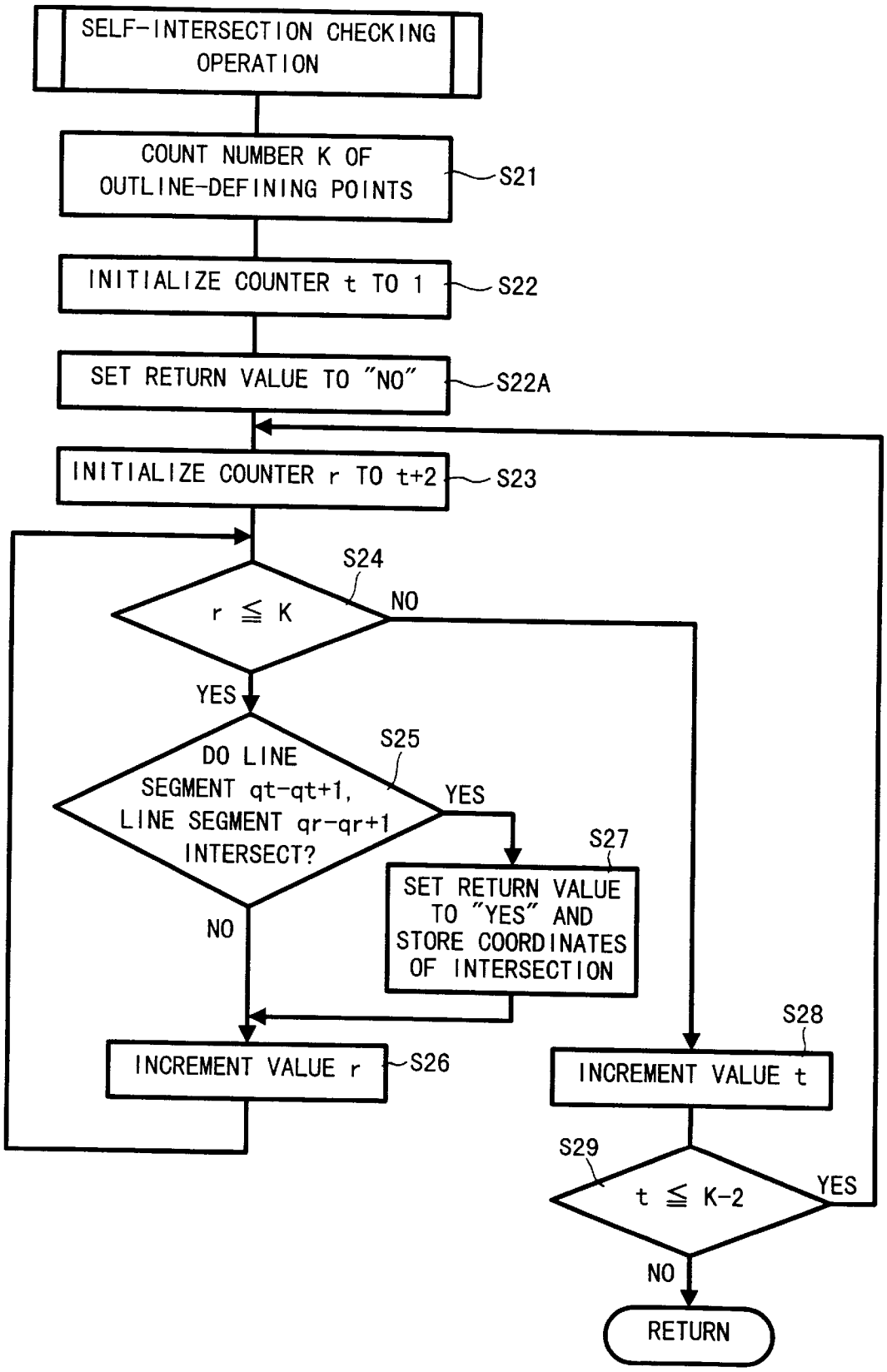
FIG. 7 is a flowchart illustrating an operation of checking for a self-intersecting point in an underlying stitch area outline.

The checking for self-intersection of step S3 will be described in detail with reference to the flowchart of FIG. 7.

In step S21, the number K of points defining the underlying stitch area outline is counted. In the example shown in FIG. 4, the number K is 15.

In step S22, a counter t is initialized to 1.

In step S22, a return value is set to NO.

In step S23, a counter r is initialized to t+2 (that is, 3 in this case).

In step S24, it is determined whether the value of the counter r is equal to or less than the number K of the outline-defining points. Since the valuer is presently 3 and the number K is presently 15, the determination in step S24 is YES, and the operation proceeds to step S25.

In step S25, it is determined whether a line segment of qt to qt+1 and a line segment of qr to qr+1 intersect each other. In the present stage, it is determined whether the line segment of q1 to q2 and the line segment of q3 to q4 intersect. Because the line segment of q1–q2 and the line segment of q3–q4 do not intersect as can be seen in FIG. 4, the determination in step S25 is NO, and the operation proceeds to step S26.

In step S26, the value of the counter r is incremented (r=4). The operation subsequently returns to step S24. Similar processing is repeated until the value of the counter r exceeds the number K (=15) of the outline-defining points.

When it is determined in step S24 that the counter value r has exceeded the number K (NO in step S24), the operation proceeds to step S28.

In step S28, the value of the counter t is incremented (t=2).

Subsequently, in step S29, it is determined whether the value of the counter t is equal to or less than the value obtained by subtracting 2 from the number K of the outline-defining points. Since the value t presently equals 2 and the value (K−2) equals 13, the determination in step S29 is YES, and the operation returns to step S23.

A similar operation is continued until the value of the counter t becomes 3 and the value of the counter r becomes 11. Since the line segment of P3 to P4 and the line segment of P11 to P12 intersect, the determination in step S25 is YES, and the operation goes to step S27.

In step S27, the coordinates of the intersecting point between the line segment P3–P4 and the line segment P11–P12 are determined, and stored into RAM 13 and the return value is set to "YES" based on the result of determination regarding self-intersection in step S25. Therefore, the self-intersection checking operation is followed by step S26 and processing continues until all line segments have been checked.

Figure 3:
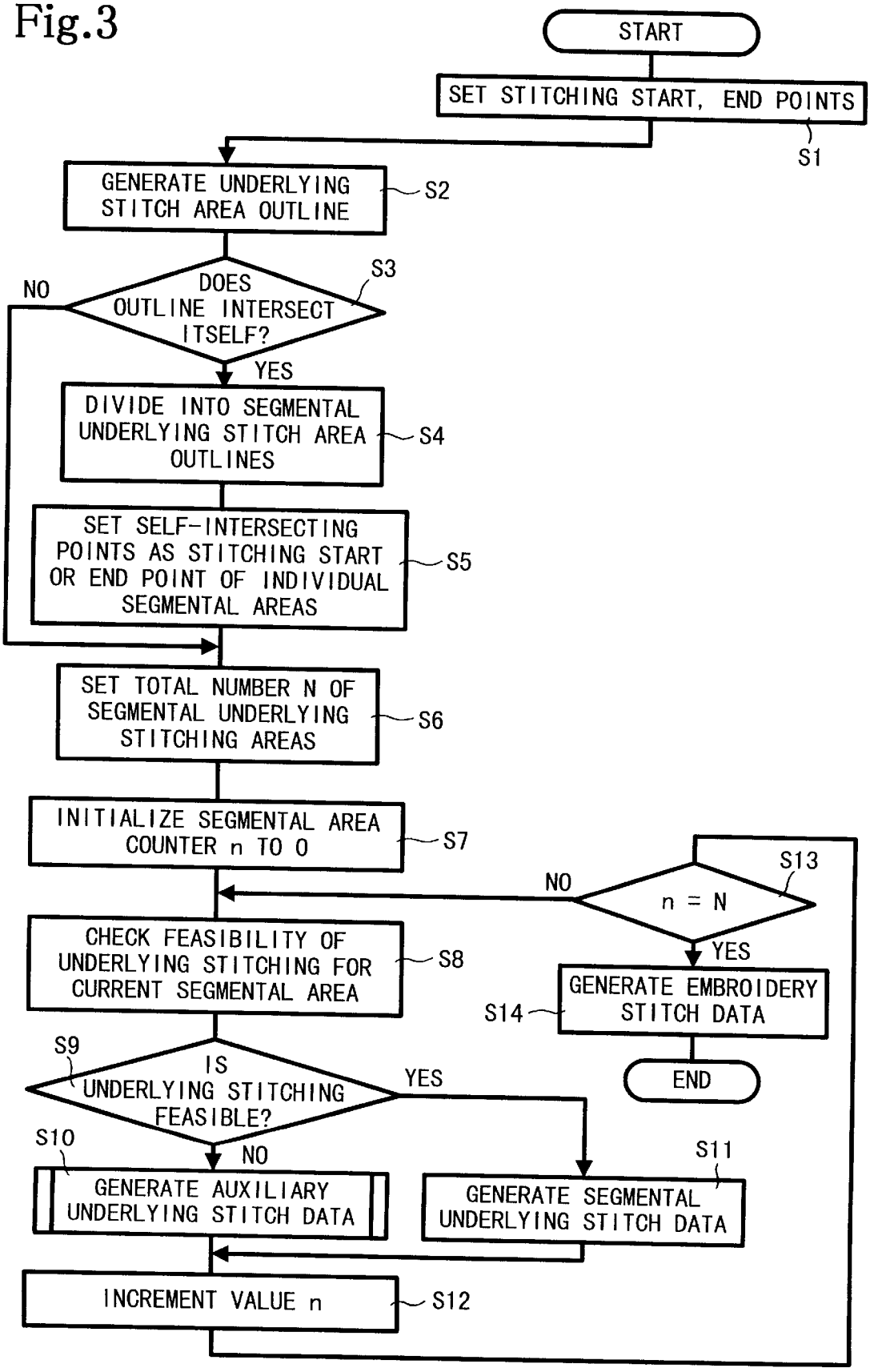
FIG. 3 is a flowchart illustrating an example of the underlying stitch data generating operation performed by the embroidery data processing apparatus of the embodiment.

Alternatively, if no self-intersection has been determined, when the value of the counter t becomes 14, it is determined in step S29 that the value t has exceeded the value (K−2), that is, 13 (NO in step S29), and the checking operation is followed by step S6 in FIG. 3. It is to be noted that when r=K, then the point qt+1 would be undefined, i.e. non-existent point q16 in this example. Thus, the routine uses q1 which is the next point on the outline as qt+1.

The checking for self-intersection of the underlying stitch area outline is thus performed in steps S21–S30 as described.

In step S4, the underlying stitch area outline is divided into a plurality of segmental underlying stitch area outlines to eliminate the self-intersection. Specifically, the underlying stitch area outline connecting the points q1–q15 shown in FIG. 4 is divided into a segmental underlying stitch area outline connecting q1–q3, A1, q12–q15, a segmental underlying stitch area outline connecting A1, q4, A2, q11, and a segmental underlying stitch area outline connecting A2, q5–q10.

In step S5, the CPU 11 sets the self-intersecting points A1, A2 as the stitching start point or the stitching end point for each of the segmental underlying stitch area outlines. The method for determining which of the self-intersecting points is set as the stitching start point or stitching end point for the individual segmental underlying stitch area outlines will be described. In the example shown in FIG. 4, the entire underlying stitch area is divided into three segmental underlying stitch areas: the segmental underlying stitch area U1 enclosed by the segmental underlying stitch area outline connecting the points q1–q2, A1, q12–q15; the segmental underlying stitch area U2 enclosed by the segmental underlying stitch area outline connecting A1, q4, A2, q11; and the segmental underlying stitch area U3 enclosed by segmental underlying stitch area outline connecting A2,q5–q10. Assuming that the stitching start point for the entire closed area is set to a point p14 of the embroidery stitch area outline corresponding to the point q14 defining the segmental underlying stitch area U1, and that the stitching end point for the entire closed area is set to a point p7 of the embroidery area outline corresponding to the point q7 defining the segmental underlying stitch area U3, the sequence for stitching the segmental underlying stitch areas is determined such that the segmental area U1 is the first to be stitched, the segmental area U2 is the second, and the segmental area U3 is the third, on the basis of the connecting relationship among the three segmental areas.

Figure 8:
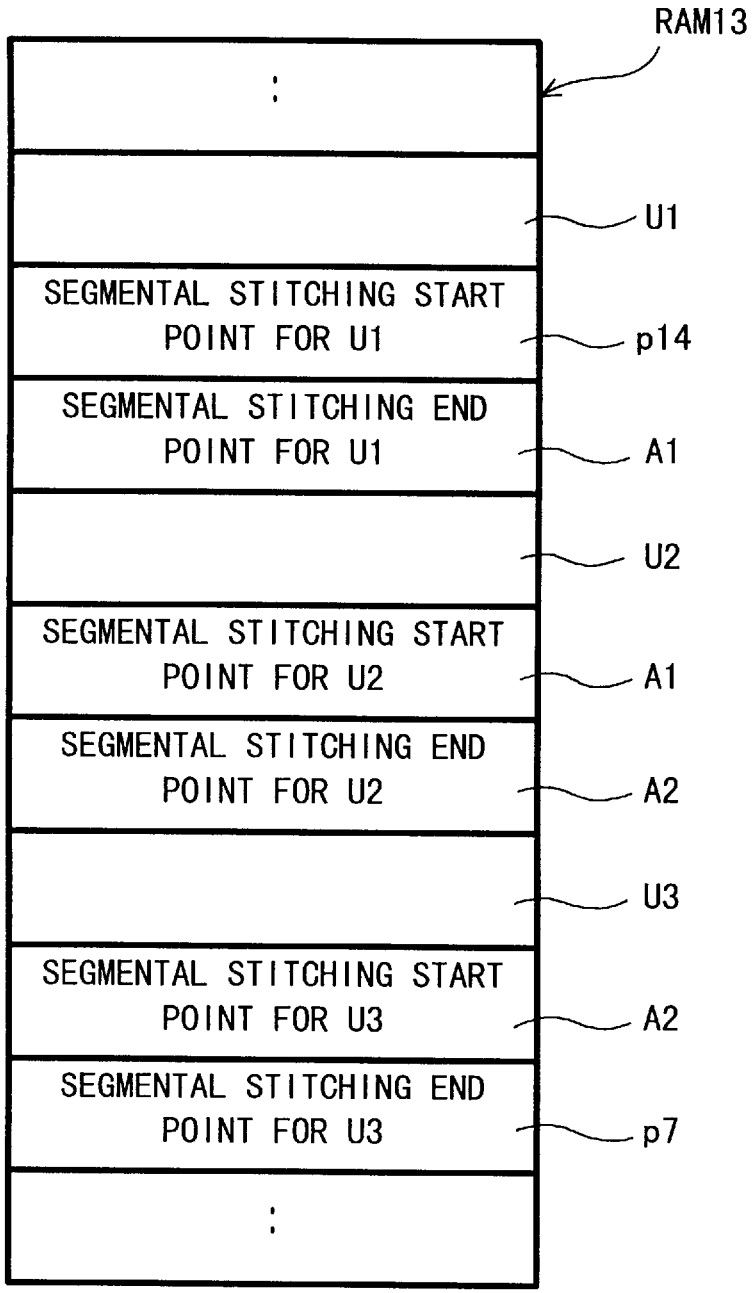
FIG. 8 schematically illustrates how the RAM stores stitching start and end point data for each segmental underlying stitch area.

Therefore, the self-intersecting point A1, that is, the connecting point between the segmental area U1 to be stitched first and the segmental area U2 to be stitched next, is set as the stitching end point for the segmental underlying stitch area outline U1 and the stitching start point for the underlying stitch area outline U2. The self-intersecting point A2, that is, the connecting point between the segmental area U2 to be stitched second and the segmental area U3 to be stitched third, is set as the stitching end point for the segmental underlying stitch area outline U2 and the stitching start point for the underlying stitch area outline U3. The thus-set stitching start and end point data is stored into the RAM 13 as illustrated in FIG. 8.

In step S6, the total number N of segmental underlying stitch areas is set. In the example shown in FIG. 4, three segmental underlying stitch areas, that is, the segmental areas U1, U2 and U3, exit, so that the number N is set to 3.

Figure 9:
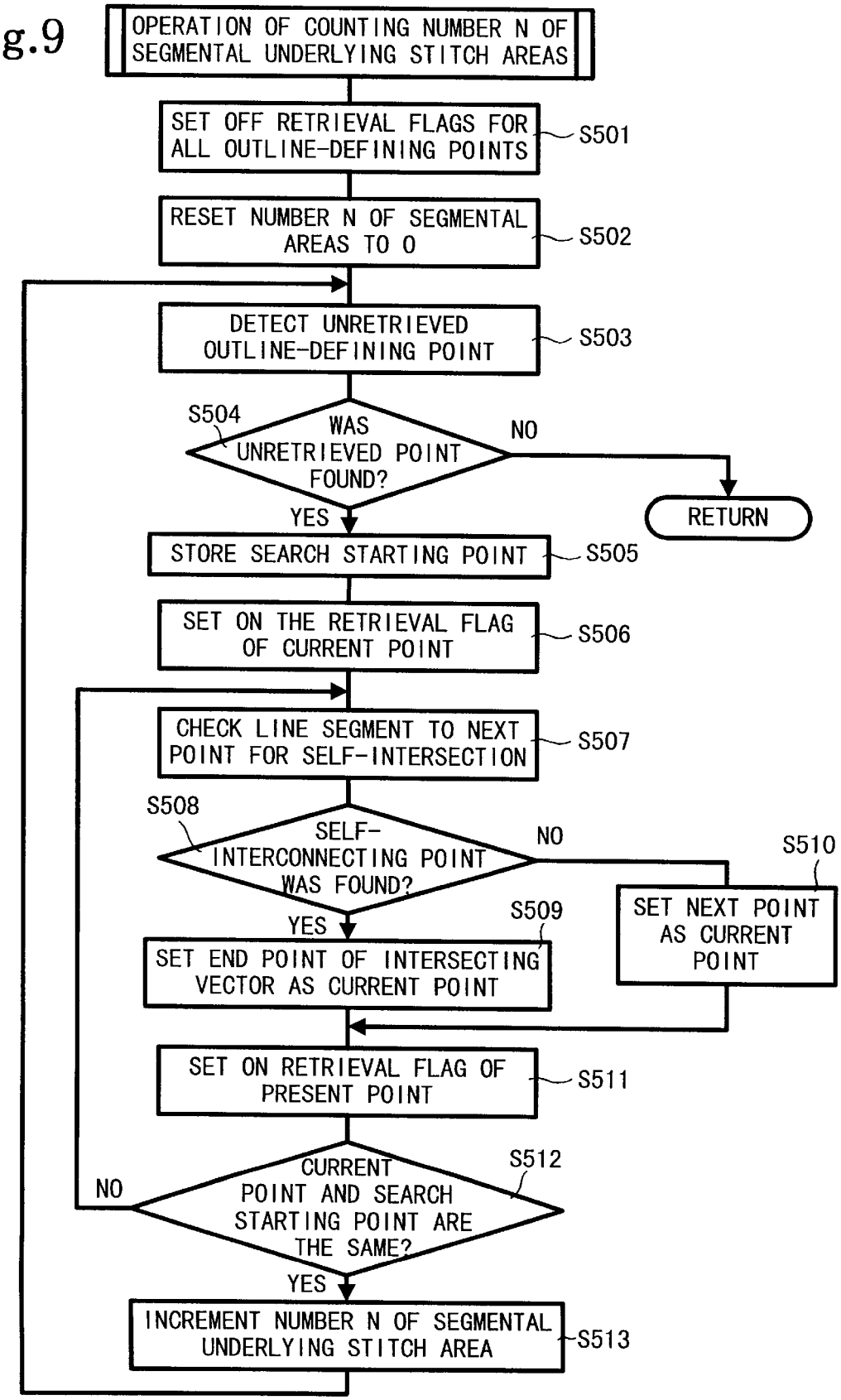
FIG. 9 is a flowchart illustrating an operation of counting the number of segmental underlying stitch areas.

The operation of counting the total number N of segmental underlying stitch areas of step S6 will be described in detail with reference to the flowchart of FIG. 9.

In step S501, flags indicating retrieval of the individual points defining the underlying stitch area outline for self-intersection search are set to "OFF" (indicating unretrieved). A flag is set to "ON" when the corresponding outline-defining point is retrieved for self-intersection search in a later stage of the operation.

In step S502, the total number N of segmental underlying stitch areas is reset to 0.

In step S503, an unretrieved outline-defining point, that is, a point that has not been retrieved for self-intersection search, is searched for. Specifically, an outline-defining point with the corresponding flag being "OFF" is searched for, by serially checking the retrieval flags in the sequence of the flags of the points q1 toward q15 shown in FIG. 4. In the present stage, the point q1 is detected as an unretrieved outline-defining point.

In step S504, it is determined whether an unretrieved outline-defining point has been found in step S503. Since the point q1 was found as an unretrieved point and therefore extracted in step S503 in the present stage, the determination in step S504 is YES, and the operation proceeds to step S505.

In step S505, the outline-defining point retrieved in step S503 is stored into the RAM 13 as a search staring point S for the purpose of counting the number of segmental underlying stitch areas. In the present stage, the point q1 is stored into the RAM 13 as a search staring point. The point q1 is treated as a current point for self-intersection search.

In step S506, the retrieval flag of the point q1, which is the current point, is set to "ON" (indicating retrieved).

In step S507, the line segment from the current point q1 to the next point q2 is checked for the presence of a self-intersecting point of the underlying stitch area outline.

In step S508, it is determined whether a self-intersecting point of the underlying stitch area outline was found in the line segment presently concerned in step S507. In the present stage, the determination in step S508 is NO because the line segment q1–q2 does not have a self-intersecting point of the underlying stitch area outline as indicated in FIG. 4. The operation then goes to step S510.

In step S510, the point q2, which has been used as the next point, is set as a current point.

In step S511, the retrieval flag of the current point that is, the point q2, is set to "ON" (indicating retrieved).

In step S512, it is determined whether the current point and the search starting point S are one and the same point. Since the current point q2 for the search and the search starting point q1 are not the same, the determination in step S512 is NO, and the operation returns to step S507.

Similar processing continues until the current and next points for search become the point q3 and the point q4, respectively. In step S507, the line segment q3–q4 is checked for the presence of a self-intersecting point of the underlying stitch area outline. Since the line segment q3–q4 has a self-intersecting point A1 of the underlying stitch area outline as indicated in FIG. 4, the presence of the self-intersecting point A1 on the line segment q3–q4 is confirmed in step S507. The determination in step S508 therefore is YES, and the operation proceeds to step S509.

In step S509, the end point of the vector (line segment) intersecting with the presently-concerned line segment at the self-intersecting point of the underlying stitch area outline is set as a current point. In the present stage, the end point q12 of the vector q11–q12 intersecting with the concerned line segment q3–q4 is set as a current point, the decision rule being select the higher numbered point, for the next search for a self-intersecting point.

In step S511, the retrieval flag of the current point q12 for search is set to "ON".

Because the current point q12 and the search starting point q1 are not the same, the determination in step S512 is NO, and the operation returns to step S507.

Similar processing continues until step S510 sets the point q1 as a current point for search, which occurs after the current and next points for search have been set to the point q15 and the point q1. In step S512, it is determined that the current point q1 for search and the search starting point q1 are the same point. The operation then proceeds to step S513.

In step S513, the number N of segmental underlying stitch areas (N=0) is incremented (to N=1). The operation then returns to step S503.

In step S503, an unretrieved outline-defining point is searched for. In the present stage, the point q4 is detected and extracted as an unretrieved point because the point q4 is the first point with the corresponding retrieval flag being "OFF" that is detected by serially checking the retrieval flags of outline-defining points in the sequence of the flags of points q1 toward q15.

In step S505, the point q4 is set as a search starting point.

After the flag of the current point for search is set to "ON" in step S506, the presence of a self-intersecting point A2 of the underlying stitch area outline in the line segment from the current point q4 to the next point q5 is confirmed in step S507. Therefore, the determination in step S508 is YES, and the operation proceeds to step S509.

In step S509, the end point q11 of the vector q10–q11 intersecting the line segment q4–q5 is set as a new current point. The subsequent operation is continued to return to step S507.

After the flag of the current point q1 for search is set to "ON" in step S506, the presence of the self-intersecting point A1 of the underlying stitch area outline in the line segment from the current point q11 to the next point q12 is confirmed in step S507. Therefore, the determination in step S508 is YES, and the operation proceeds to step S509.

In step S509, the end point q4 of the vector q3–q4 intersecting the line segment q11–q12 is set as anew current point.

In step S512, it is determined that the current point q4 and the search staring point q4 are the same point. The operation then proceeds to step S513.

In step S513, the number N of segmental underlying stitch areas (N=1) is incremented (to N=2). The operation then returns to step S503.

In step S503, an unretrieved outline-defining point is searched for. In the present stage, the point q5 is detected and extracted as an unretrieved point because the point q5 is the first point with the corresponding retrieval flag being "OFF" that is detected by serially checking the retrieval flags of outline-defining points in the sequence of the flags of points q1 toward q15.

In step S505, the point q5 is set as a search starting point.

Processing similar to that described above continues until the current and next points for search become the point q10 and the point q11, respectively. In step S507, it is confirmed that the presence of the self-intersecting point A2 of the underlying stitch area outline is present on the line segment q10–q11. Therefore, the determination in step S508 is YES.

In step S509, the end point q5 of the vector q4–q5 intersecting the line segment q10–q11 is set as a new current point.

After the retrieval flag of the current point q5 is set to "ON" in step S511, it is determined in step S512 that the current point q5 and the search stating point q5 are the same point, and the operation proceeds to step S513.

In step S513, the number N of segmental underlying stitch areas (N=2) is incremented (to N=3). The operation then returns to step S503.

Since the retrieval flags of all the outline-defining points q1–q15 have been set to "ON", an unretrieved outline-defining point cannot be detected in step S503. Therefore, the determination in step S504 is NO, and the operation goes to step S7 in FIG. 3.

The number N (=3) of segmental underlying stitch areas is thus counted by the operation of steps S501 to S513.

If it is determined in step S3 in FIG. 3 that the underlying stitch area outline does not intersect itself, the total number N of segmental underlying stitch areas is set to 1 in step S6.

In step S7, the value of a segmental underlying stitch area counter n is initialized to 0.

In step S8, a segmental underlying stitch area, for example, the first segmental underlying stitch area U1, is checked for feasibility of underlying stitching, that is, it is checked whether all the points q1–q3, A1, q12–q15 that define the segmental underlying stitch area U1, are present within the outline defined by the points p1–p15. In step S9, it is determined whether underlying stitching in the segmental area is feasible. Because the points q1–q3, A1, q12–q15 are within the outline defined by the points p1–p15 as shown in FIG. 4, it is determined in step S9 that generation of normal underlying stitch data is possible (YES in step S9). The operation then goes to step S11.

In step S11, normal segmental underlying stitch data for the segmental underlying stitch area U1 is generated, using the self-intersecting point A1 set in step S5 as a stitching end point. The method of generating segmental underlying stitch data may be substantially the same as the conventional method described above, and will not described again.

In step S12, the value of the underlying stitch area counter n is incremented (to n=1). In step S13, it is determined that the value n (=1) does not equal the value N (=3) (NO in step S13). The operation then returns to step S8.

In step S8, the second segmental underlying stitch area U2 is checked for feasibility of underlying stitching, that is, it is checked whether all the points A1, q4, A2, q11 that define the segmental underlying stitch area U2 are present within the outline defined by the points p1–p15. Because the point q11 is outside the outline defined by the points p1–p15 as shown in FIG. 4, it is determined in step S9 that generation of normal underlying stitch data is impossible (NO in step S9). The operation then goes to step S10.

In step S10, auxiliary underlying stitch data is generated for the segmental underlying stitch area U2. The operation of generating auxiliary underlying stitch data will be described with reference to the flowchart of FIG. 6.

Figure 6:
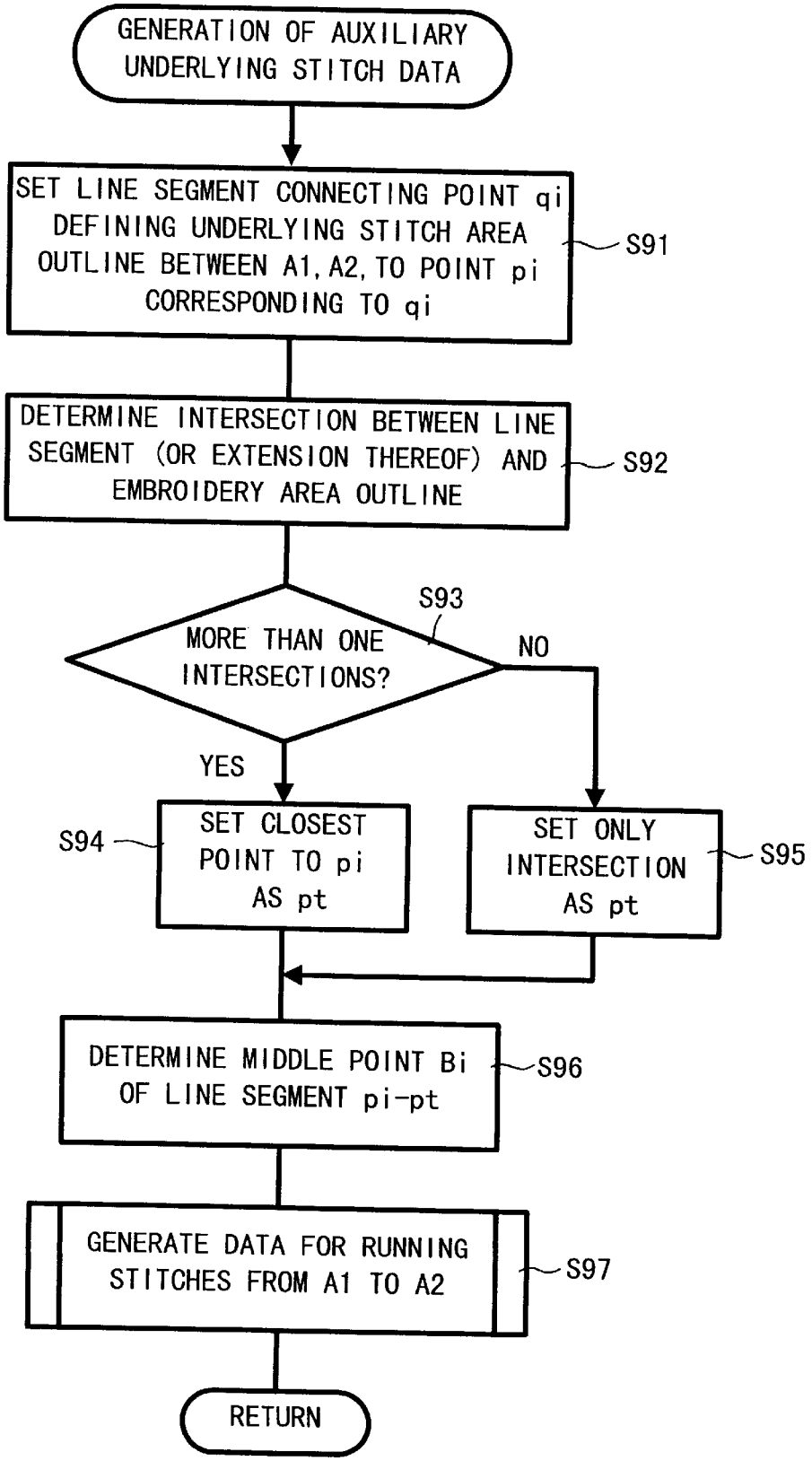
FIG. 6 is a flowchart illustrating an example of the auxiliary underlying stitch data generating operation performed by the embroidery data processing apparatus of the embodiment.

In step S91 in FIG. 6, the CPU 11 sets a line segment connecting an outline-defining point qi on a segment of the underlying stitch area outline extending between the self-intersecting points A1 and A2 of the underlying stitch area outline, relative to an embroidery area outline-defining point pi corresponding to the point qi. In the example shown in FIG. 4, the outline-defining points q11, q4, present on the segment of the underlying stitch area outline extending between the self-intersecting points A1 and A2 are extracted. Then, line segments connecting the points q11, q4 to the embroidery area outline-defining points p11, p4 corresponding to the points q11, q4 are set.

In step S92, the CPU 11 determines intersecting points between the embroidery area outline and the line segments q11–p11 and q4–p4 set in step S91 or between embroidery area outline and extensions from the line segments in directions from pi to qi.

In step S93, it is determined whether the number of the intersecting points on each line segment determined in step S92 is more than one. The line segment q11–p11 has only one intersecting point with a segment p3–p4 of the embroidery area outline. Therefore, with regard to the line segment q11–p11, the operation proceeds to step S95, where the only intersecting point is set as a point pt (=p11'). The line segment q4–p4 also forms only one intersecting point at which an extension from the line segment in the direction from p4 to q4 intersects with a segment p10–p11 of the embroidery area outline. Therefore, with regard to the line segment q4–p4, the operation proceeds to step S95, where the only intersecting point is set as a point pt (=p4'). If it is determined in step S95 that the number of the intersecting points on each line segment is more than one, the operation proceeds to step S94, where the closest intersecting point to the point pi, which is an end point of the line segment, is set as a point pt.

In step S96, the CPU 11 determines the middle point of a line segment p1–pt connecting between the intersecting point pt determined in step S94 or S95 and the outline-defining point pi corresponding to the intersecting point pt. That is, the middle point B1 of the line segment q11–p11' and the middle point B2 of the line segment p4–p4' are determined.

Figure 10:
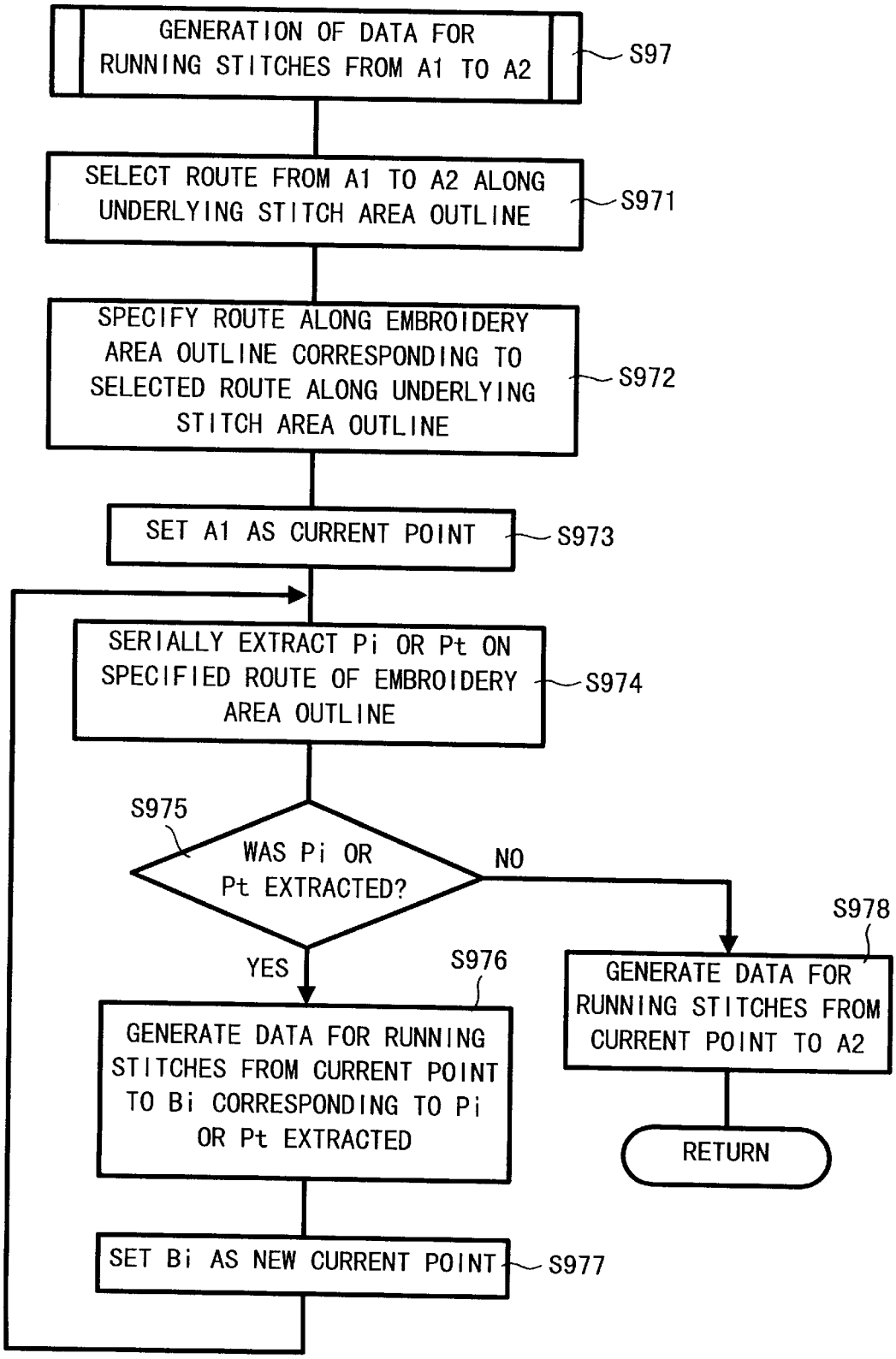
FIG. 10 is a flowchart illustrating an operation of generating data for running stitches.

In step S97, the CPU 11 generates auxiliary underlying stitch data for the segmental underlying stitch area U2 from the segmental stitching start point A1 to the segmental stitching end point A2, that is, running stitch data. The operation of generating running stitch data from A1 to A2 will be described in detail with reference to the flowchart of FIG. 10.

In step S971, either one of the two routes extending from A1 to A2 along the underlying stitch area outline is automatically selected. In the description below, it is assumed that the route A1-q11-A2 is selected.

In step S972, a route on the embroidery area outline corresponding to the route selected in step S971 is specified. That is, a route p12-p11-p10 is specified as a route on the embroidery area outline corresponding to the route A1-q11-A2.

In step S973, the point A1 is set as a current point.

In step S974, the CPU 11 serially extracts the points pi or pt on the route along the embroidery area outline specified in step S972, one point at a time. That is, the point p11 is first extracted by serially tracing the outline segment extending from p12 to p10.

In step S975, it is determined whether a point pi or pt was extracted in step S974. In the present example, since the point p11 was extracted in step S974, the determination in step S975 is YES, and the operation proceeds to step S976.

In step S976, running stitch data is generated for stitching from the middle point Bi between the points pi and pt extracted in step S974. That is, data for running stitches from the current point A1 to the middle point B1 of the line segment p11–p11'.

In step S977, the end point B1 for the running stitch data generated in step S976 is set as a new current point. That is, the point B1 is set as a new current point. The operation returns to step S974.

In step S974, the points pi or pt on the route along the embroidery area outline specified in step S972 are serially extracted one at a time. That is, the point p4' is extracted following the point 11, by serially tracing the outline segment extending from p12 to p10.

In step S975, it is determined whether a point pi or pt was extracted in step S974. In the present stage, since the point p4' was extracted in step S974, the determination in step S975 is YES, and the operation proceeds to step S976.

In step S976, running stitch data is generated for stitching from the middle point Bi between the points pi and pt extracted in step S974. That is, data for running stitches from the current point B1 to the middle point B2 of the line segment p4–p4'.

In step S977, the end point B2 for the running stitch data generated in step S976 is set as a new current point. The operation returns to step S974.

In step S974, the points pi or pt on the route along the embroidery area outline specified in step S972 are serially extracted one at a time. That is, extraction of a point pi or pt following the point p4' is attempted, by serially tracing the outline segment extending from p12 to p10. However, no new point is extracted since there exists no such point.

The determination in step S975 is NO since step S974 did not extract a new point. The operation then goes to step S978.

In step S978, data for running stitches from the current point B2 to the point A2 is generated. The operation then goes to step S12 in FIG. 3.

The running stitch data, that is, auxiliary underlying stitch data, is thus generated by the operation of steps S971 to S978.

In step S12 in FIG. 3, the value of the underlying stitch area counter n is incremented (to n=2). In step S13, it is determined that the value n (=2) does not equal the number N (=3). The operation then returns to step S8.

In step S8, the third segmental underlying stitch area U3 is checked for feasibility of underlying stitching, that is, it is checked whether all the points A2, q5–q10 that define the segmental underlying stitch area U3 are present within the outline defined by the points p1–p15. Because the points A2, q5–q10 are inside the outline defined by the points p1–p15 as shown in FIG. 4, it is determined in step S9 that generation of normal underlying stitch data is possible (YES in step S9). The operation then goes to step S10.

In step S11, normal segmental underlying stitch data for the segmental underlying stitch area U3 is generated, using the self-intersecting point A2 set in step S5 as a stitching start point.

Figure 5:
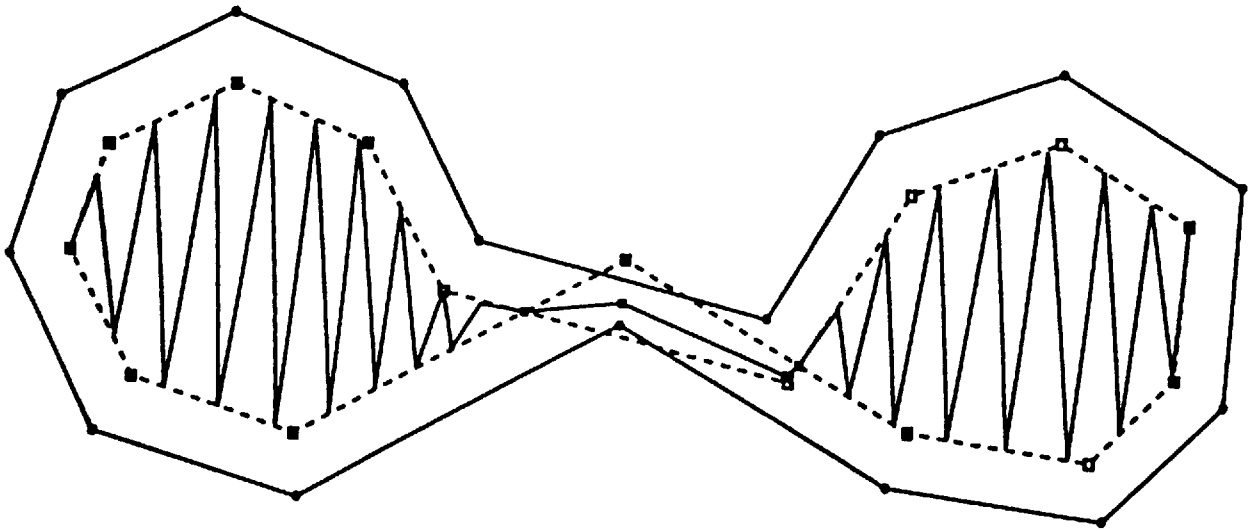
FIG. 5 schematically illustrates the underlying stitch data generated by the embroidery data processing apparatus of the embodiment.

In step S12, the value of the underlying stitch area counter n is incremented (to n=3). In step S13, it is determined that the value n (=3) equals the value N (=3) (YES in step S13). The stitching operation based on the underlying stitch data generated by the processing described above is schematically shown in FIG. 5.

In step S14, embroidery stitch data for filling the interior of the embroidery area enclosed by the outline p1–p5 is generated. The method of generating embroidery stitch data may be substantially the same as the method employed by typical conventional embroidery data processing apparatuses, and will not be described here.

The stitch data for underlying stitching and embroidery stitching, generated as described above, is transmitted to the embroidery sewing machine 25, via the output interface 18 and the communication cable 20 shown in FIG. 2. Therefore, an embroidery is formed by the sewing machine 25 based on the stitch data With regard to a segmental underlying stitch area for which segmental underlying stitch data cannot be generated by a conventional method, the processing in step S10 in this embodiment running stitch data as auxiliary underlying stitch data. Therefore, a user is enabled to obtain underlying stitch data such that threads connecting between segmental underlying stitch areas are contained within the embroidery area.

Although, in the foregoing embodiment, a user manually inputs the stitching start and end points in step S1, it is also possible to automatically set such points by the CPU 11 executing programs for setting the points.

Although, in the foregoing embodiment, the embroidery data processing apparatus generates stitch data, and outputs the data to the embroidery sewing machine, it is also possible to employ an arrangement wherein the embroidery data processing apparatus generates data regarding outlines, stitching characteristics, and the like and outputs the data to the embroidery machine, which generates stitch data based on the data from the embroidery data processing apparatus.

As apparent from the foregoing description, in the embroidery data processing apparatus of the invention, in the apparatus, an underlying stitch area outline generating device generates an underlying stitch area outline that defines a shape of an area to be stitched for underlying. The underlying stitch area outline is generated inside the closed area. If the underlying stitch area outline has a self-intersecting portion, a dividing device divides the underlying stitch area outline into a plurality of segmental underlying stitch area outlines using the self-intersecting portion as a boundary. A segmental underlying stitch data generating device generates underlying stitch data for each of segmental underlying stitch areas defined by the plurality of segmental underlying stitch area outlines. An auxiliary underlying stitch data generating device generates auxiliary underlying stitch data for a connection between the plurality of segmental underlying stitch areas. Therefore, it becomes possible to easily generate underlying stitch data whereby the threads interconnecting segmental underlying stitch areas are contained within the embroidery area, even if the underlying stitch area outline intersects itself.

In the foregoing preferred embodiment of the invention, the embroidery data processing apparatus further includes a setting device that sets a point at which the underlying stitch area outline intersects itself, as one of a stitching start point and a stitching end point for the individual segmental underlying stitch areas. Therefore, it becomes possible to generate underlying stitch data that enables the quick embroidering of each segmental underlying stitch area with a high efficiency.

In the foregoing preferred embodiment, the auxiliary underlying stitch data generated by the auxiliary underlying stitch data generating device includes data for producing running stitches at a given pitch. Therefore, it becomes possible to generate data for running stitches at an appropriate pitch or data for feed-stitching (generally termed as "jump stitching"), as auxiliary underlying stitch data for connections between segmental underlying stitch areas.

It is to be understood that the invention is not restricted to the particular forms shown in the foregoing embodiment. Various modifications and alternations can be made thereto without departing from the scope of the invention encompassed by the appended claims.

What is claimed is:

1. An embroidery data processing apparatus for processing embroidery data for forming underlying stitches within a closed area enclosed by an outline that defines a shape of an embroidery area, comprising:

an underlying stitch area outline generating device that generates an underlying stitch area outline that defines a shape of an area to be stitched for underlying, the underlying stitch area outline being generated inside the closed area;

a dividing device that, if the underlying stitch area outline has a point at which the outline intersects itself, called a self-intersecting portion, divides the underlying stitch area outline into a plurality of segmental underlying stitch area outlines using the self-intersecting portion as a boundary;

a segmental underlying stitch data generating device that generates underlying stitch data for each of segmental underlying stitch areas defined by the plurality of segmental underlying stitch area outlines; and an auxiliary underlying stitch data generating device that generates auxiliary underlying stitch data for a connection between the plurality of segmental underlying stitch areas.

2. An embroidery data processing apparatus according to claim 1, wherein the auxiliary underlying stitch data generated by the auxiliary underlying stitch data generating device includes data for producing running stitches at a given pitch.

3. An embroidery data processing apparatus according to claim 1, further comprising a setting device that sets a point at which the underlying stitch area outline intersects itself, as one of a stitching start point and a stitching end point for the individual segmental underlying stitch areas.

4. An embroidery data processing apparatus according to claim 3, wherein the auxiliary underlying stitch data generated by the auxiliary underlying stitch data generating device includes data for producing running stitches at a given pitch.

5. An embroidery data processing device for creating stitches underlying an embroidery area, comprising:

an underlying outline generating device that generates an underlying outline offset by a predetermined distance from a primary embroidery outline;

a segment designating device that designates closed segments when the underlying outline has at least one point where the outline crosses itself called a self-intersecting point; and an interior segment determination device that identifies closed segments that lie entirely within the primary embroidery-outline and closed segments having a portion lying outside the primary embroidery outline.

6. The device according to claim 5, further comprising a segment stitch data creation device that creates stitch data for the closed segments lying entirely within the primary embroidery outline.

7. The device according to claim 6, further comprising a linking stitch data creating device that creates running stitch data passing through those closed segments having a portion outside the primary embroidery outline.

8. The device according to claim 7, wherein the running stitch data lies entirely within the primary embroidery outline.

9. The device according to claim 6, further comprising a setting device that sets a point at which the underlying outline intersects itself as one of a stitching start point and a stitching end point for the closed area lying entirely within the primary embroidery outline having the intersection on its periphery.

10. A storage medium for storing programs to create underlying stitch patterns, comprising programs to:

define an embroidery pattern outline;

create an underlying stitch pattern outline;

determine whether the underlying stitch pattern outline crosses itself, called self intersection and the point of crossing called a self intersection point; and identify portions of the underlying stitch pattern outline lying outside of the embroidery pattern outline.

11. The storage medium according to claim 10, wherein the program to create an underlying stitch pattern outline further comprises:

an offset distance setting routine establishing a distance between the embroidery pattern outline and the underlying stitch pattern outline; and a parallel line creation routine for creating the underlying stitch pattern outline that parallels the embroidery pattern outline but is offset by the established distance.

12. The storage medium according to claim 10, further comprising a routine for designating closed areas within the underlying stitch pattern outline when there is a determination of self intersection.

13. The storage medium according to claim 12, further comprising a program for designating each self intersection point as one of a start stitch point and an end stitch point for a closed area containing the self intersection point.

14. The storage medium according to claim 13, further comprising a program for generating underlying stitch data for each closed area.

15. The storage medium according to claim 10, further comprising a program for creating auxiliary stitch data entirely within the embroidery pattern outline when a portion of the underlying stitch pattern is identified as lying outside of the embroidery pattern outline.

16. The storage medium according to claim 15, wherein the program for creating auxiliary stitch data creates running stitch data and contains a sub-routine for selecting a pitch of the running stitch.

* * * * *